US007560014B2

(12) United States Patent
Rucker et al.

(10) Patent No.: US 7,560,014 B2
(45) Date of Patent: Jul. 14, 2009

(54) METHOD FOR AIRFOIL ELECTROPLATING

(75) Inventors: Michael Rucker, Cincinnati, OH (US); Bhupendra K. Gupta, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 12/194,732

(22) Filed: Aug. 20, 2008

(65) Prior Publication Data

US 2008/0302667 A1 Dec. 11, 2008

Related U.S. Application Data

(62) Division of application No. 11/146,964, filed on Jun. 7, 2005.

(51) Int. Cl.
*C25D 5/00* (2006.01)
*C25D 5/50* (2006.01)

(52) U.S. Cl. ..... 205/96; 204/DIG. 7; 205/192; 205/228

(58) Field of Classification Search ..... 205/96, 205/192, 228; 204/DIG. 7
See application file for complete search history.

(56) References Cited

U.S. PATENT DOCUMENTS 4,879,007 A * 11/1989 Wong ..... 205/137
5,667,663 A * 9/1997 Rickerby et al. ..... 205/170
6,562,227 B2 * 5/2003 Lamphere et al. ..... 205/686
6,802,950 B2 * 10/2004 Hachman et al. ..... 205/82
2005/0145503 A1 * 7/2005 Kozlov et al. ..... 205/255
2006/0037865 A1 * 2/2006 Rucker et al. ..... 205/133

* cited by examiner

*Primary Examiner*—Patrick Ryan
*Assistant Examiner*—William T Leader
(74) *Attorney, Agent, or Firm*—Adams Intellectual Property Law, P.A.; Theodore P. Cummings

(57) ABSTRACT

A method is provided for electroplating a high temperature coating onto an airfoil. The method includes providing a shield having a recess defining one or more walls conforming to the shape of at least a portion of a pressure side and a suction side of the airfoil to be electroplated, introducing the portions of the pressure side and the suction side of the airfoil to be electroplated into the recess of the shield, attaching an anode and cathode to the airfoil, submerging at least the shield and the portions of the pressure side and the suction side of the airfoil to be electroplated into an electroplating tank containing an electrolyte, and electroplating a coating of a high temperature resistant metal onto the portions of the pressure side and the suction side of the airfoil to be electroplated to a predetermined minimum thickness.

10 Claims, 4 Drawing Sheets

METHOD FOR AIRFOIL ELECTROPLATING

CROSS REFERENCE TO RELATED APPLICATION

This is a divisional application of co-pending U.S. application Ser. No. 11/146,964, filed on Jun. 7, 2005, the disclosure of which is incorporated herein in its entirety.

TECHNICAL FIELD AND BACKGROUND OF THE INVENTION

This invention relates to a method and apparatus for airfoil electroplating, and an airfoil with enhanced electroplating thickness and uniformity. The method and apparatus have particular application in regulating and controlling the deposited thickness of platinum and other platinum group metals on high span regions of turbine airfoil components during the platinum electroplating process.

Platinum aluminide coatings are applied to turbine components to provide environmental protection of the nickel substrate base metal. The application of platinum aluminide coatings is a three-step process that includes electroplating, diffusion heat treatment and aluminiding. During electroplating, platinum is plated over the surface of the component to be coated. Diffusion heat treatment creates a metallurgical bond between the nickel substrate and the layer of platinum. Aluminiding is conducted in a furnace at elevated temperatures where the platinum on the surface of the part is reacted with an aluminum vapor that creates a platinum aluminide coating.

A design challenge that is optimized during the development of a platinum aluminide coating process for a part is to minimize the thickness variation of the coating on the part. The variation in platinum aluminide coating thickness is a function of a platinum thickness and aluminum activity in vapor phase aluminide (VPA) retort. As platinum thickness increases, platinum aluminide thickness increases. As aluminum activity increases, platinum aluminide coating thickness increases. During platinum plating, parts are immersed within the plating tank with the bottom of the part attached to the cathode fixture and the top of the part submerged deepest in the tank. For a turbine blade, the bottom of the blade is the dovetail, which is not exposed to plating electrolyte while the tip of the blade is submerged deepest. Independent of electroplating anode design, the surfaces of the part that are deepest in the tank will plate thicker than the parts towards the top of the tank due to decreased temperature and flow rate of electrolyte at the top of the tank. Within the VPA retort, the aluminum vapor along the height of the part has a gradient of activity, low activity towards the bottom and higher activity towards the top. The combined effects of the platinum thickness variation in the plating tank and aluminum activity in the VPA retort have historically made uniform coating thickness distributions hard to achieve.

BRIEF DESCRIPTION OF THE INVENTION

Therefore, the present invention provides a method and apparatus for reducing variation in platinum aluminide coating thickness by controlling the amount of platinum that is plated on the sections of the part that are submerged deepest in the plating tank. A shield reduces the plating thickness by shielding the surface from current and locally reducing the flow rate of plating electrolyte solution, which results in reduced platinum thickness. By balancing the amount of platinum that is deposited, the shield can accommodate the gradient of aluminum activity within the VPA retort and assist in producing a highly uniform platinum aluminide coating.

The present invention also provides a means of tailoring and making more uniform the distribution of the platinum thickness, thus reducing platinum aluminide coating cost per part.

In addition, the present invention improves part performance due to uniform coating thickness and microstructure.

In accordance with one aspect of the invention, an apparatus is provided including a chemically-nonreactive, electrically-nonconductive shield having a recess generally corresponding to the shape of an airfoil portion to be positioned therein. The shield is submerged in an electroplating solution in a plating tank. The recess in the shield is sized to provide a predetermined, closely-spaced apart clearance between walls of the recess and the adjacent airfoil portion sufficient to reduce the flow rate of an electrolyte present in the electroplating solution between walls of the recess and the adjacent airfoil portion. The clearance permits control of the amount of electroplating that is deposited on the portion of the airfoil that is positioned in the recess in relation to portions of the airfoil not positioned in the recess. The result is a more uniform plating, with minimum plating amounts on all parts of the airfoil.

In accordance with one aspect of the invention, the chemically-nonreactive shield comprises polytetrafluoroethylene (PTFE).

In accordance with another aspect of the invention, the recess is formed by machining.

In accordance with another aspect of the invention, the airfoil comprises a turbine blade having a high span region, and the recess is formed to receive the high span region of the blade.

In accordance with another aspect of the invention, the electrolyte comprises a platinum group metal.

In accordance with another aspect of the invention, the clearance between the walls of the recess and the adjacent airfoil surfaces is between about 0.10 to 0.30 inches (2.54-7.62 mm).

In accordance with another aspect of the invention, the clearance between the walls of the recess and the adjacent airfoil surfaces is about 0.15 inches (3.81 mm).

In accordance with another aspect of the invention, an apparatus for use in platinum electroplating a high span turbine blade is provided, and comprises a polytetrafluoroethylene (PTFE) shield having a recess formed therein, the recess having a shape generally corresponding to the shape of high span portions of the blade to be positioned therein. The clearance between the walls of the recess and adjacent airfoil portions is between about 0.10 and 0.30 inches (2.54-7.62 mm) and shields the blade portions from flow currents and thus reduce the flow rate of platinum electrolyte present in an electroplating solution in which the shield and blade portions positioned therein are submerged.

In accordance with another aspect of the invention, the airfoil comprises a high span turbine blade.

In accordance with another aspect of the invention, the coating comprises a platinum aluminide coating.

In accordance with another aspect of the invention, a method of electroplating a high temperature coating onto an airfoil is provided, and comprises the steps of providing a shield having a recess conforming to the shape of at least a portion of the airfoil, the recess having a clearance determined empirically to provide an optimum coating thickness deviation, and introducing the blade into the recess of the shield. An anode and cathode is attached to the airfoil. The shield and blade portions of the airfoil are submerged into an electroplating tank containing an electrolyte solution and a coating of a high temperature resistant metal is electroplated onto the blade to a thickness where every portion of the blade to be coated has at least a minimum thickness of the metal coated thereon.

In accordance with another aspect of the invention, the method includes the steps of diffusion heat treating the blade to create a metallurgical bond between the blade and the electroplated coating, and reacting the heat treated blade with an aluminum vapor in a VPA retort to create an aluminide coating.

In accordance with another aspect of the invention, the electroplating metal is platinum, and the blade is nickel.

BRIEF DESCRIPTION OF THE DRAWINGS

Some of the aspects of the invention have been set forth above. Other aspects of the invention will appear as the invention proceeds when taken in conjunction with the following drawings, in which.

DESCRIPTION OF THE PREFERRED EMBODIMENT AND BEST MODE

Figure 1:
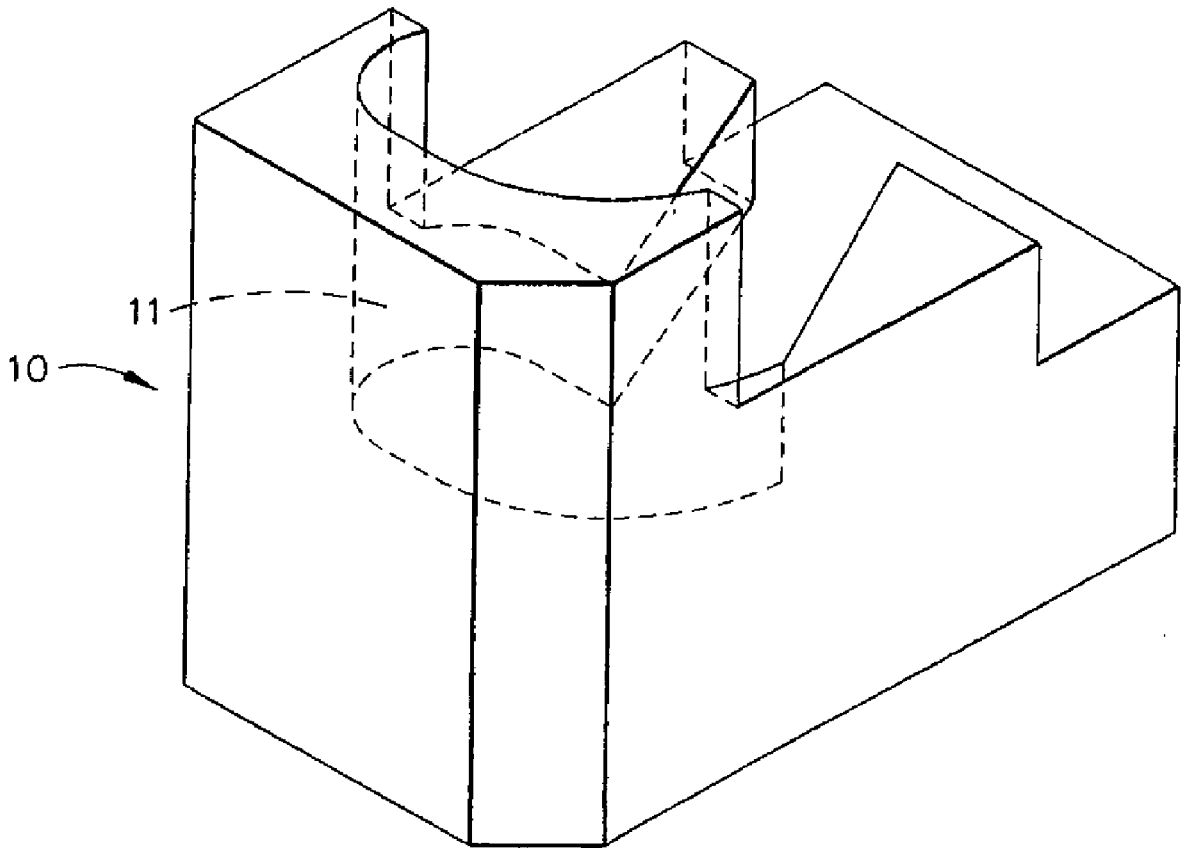
FIG. 1 is a perspective view of a high span airfoil shield according to an embodiment of the invention.
Figure 2:
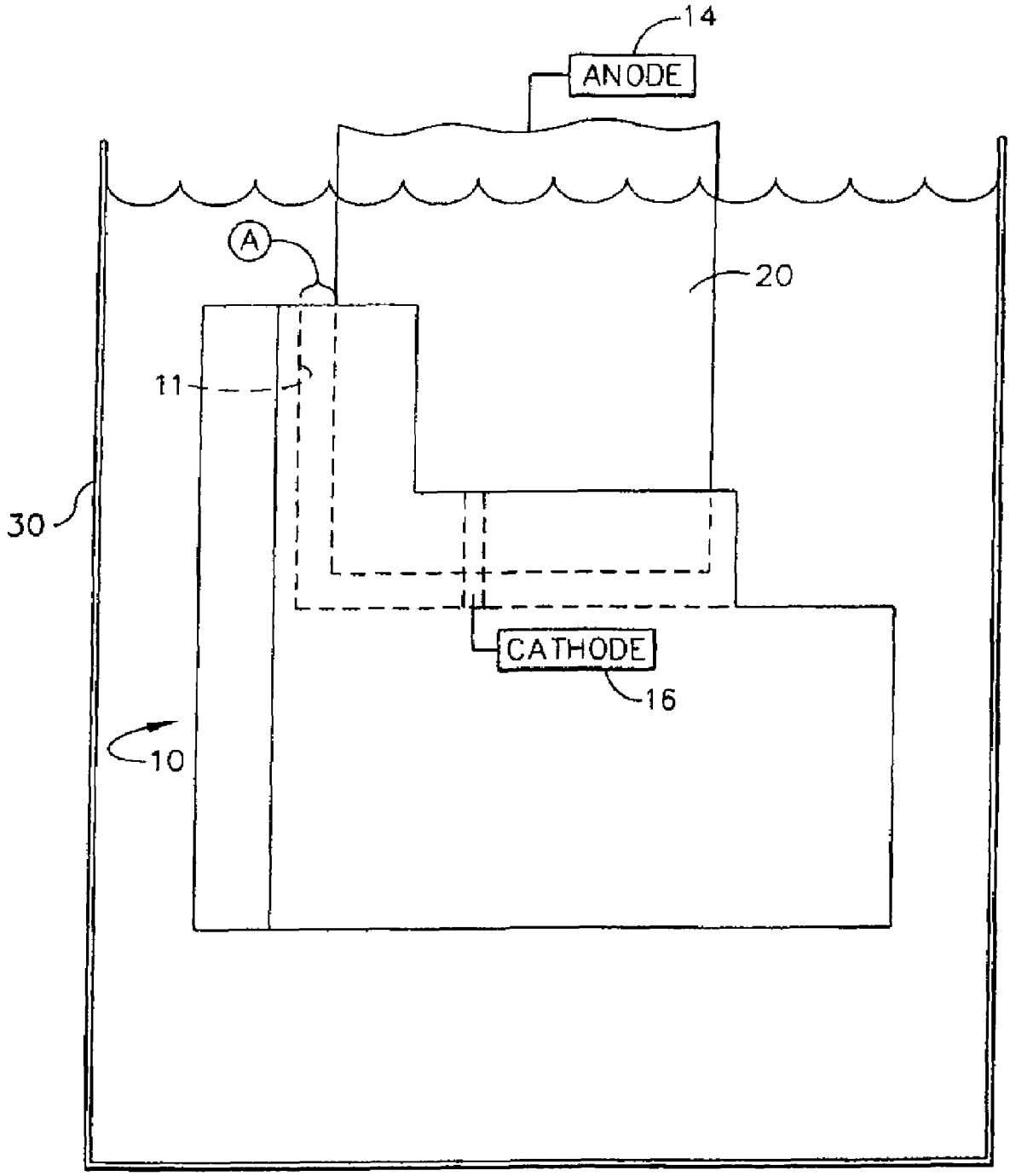
FIG. 2 is a side elevation of a high span airfoil shield and airfoil according to an embodiment of the invention.

Referring now specifically to the drawings, an electroplating airfoil shield according to the present invention is illustrated in FIGS. 1 and 2, and shown generally at reference numeral 10. The use of the shield 10 produces a tailored platinum distribution on the surface of the high span regions of the part that is to be platinum aluminide coated. According to one preferred embodiment of the invention, the shield 10 is fabricated from a solid block of polytetrafluoroethylene (PTFE). This material provides the shield 10 with both chemically-nonreactive and electrically-nonconductive characteristics. An electrically-nonconductive material such as PTFE is necessary because, otherwise, the thickness distribution of the platinum layer would degrade instead of improve.

Figure 3:
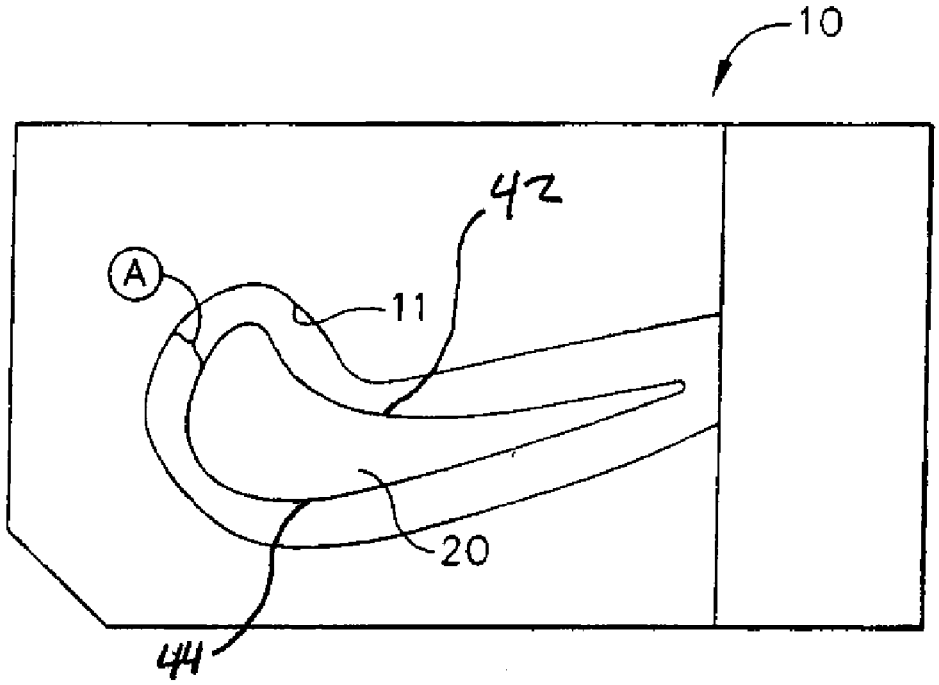
FIG. 3 is a top plan view of a high span airfoil shield and airfoil according to an embodiment of the invention.

A recess 11 is machined into the shield 10 to provide a predetermined clearance to all adjacent surfaces of a turbine blade 20 to be electroplated. As shown and described herein, the turbine blade 20 is an airfoil that defines a concave pressure sidewall 42 on a pressure side and a convex suction sidewall 44 on a suction side. The required blade-to-shield clearance is empirically determined based on the coating requirements of the part and the clearance gap "A", see FIGS. 2 and 3, may range between 0.10 and 0.30 inches (2.54-7.62 mm), with an optimum range of 0.10 to 0.20 inches (2.54-5.08 mm).

The shield 10 and attached airfoil 20 are submerged in a electroplating tank 30 where the electroplating process is carried out.

Figure 5:
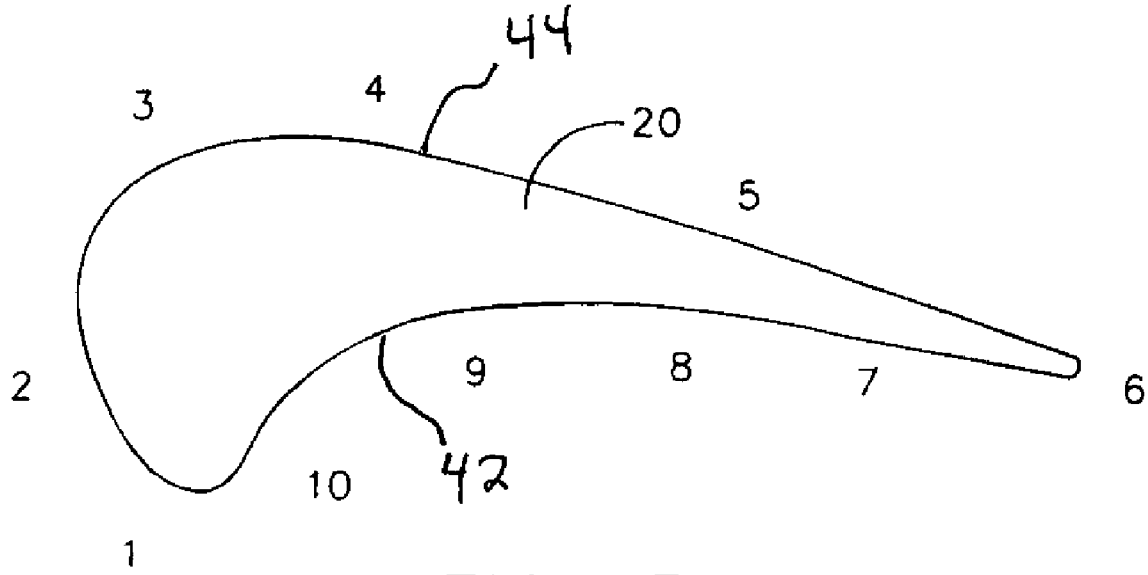
FIG. 5 is a top plan view of the airfoil shown in FIG. 3 showing the measurement locations represented in the table of FIG. 4.
Figure 4:
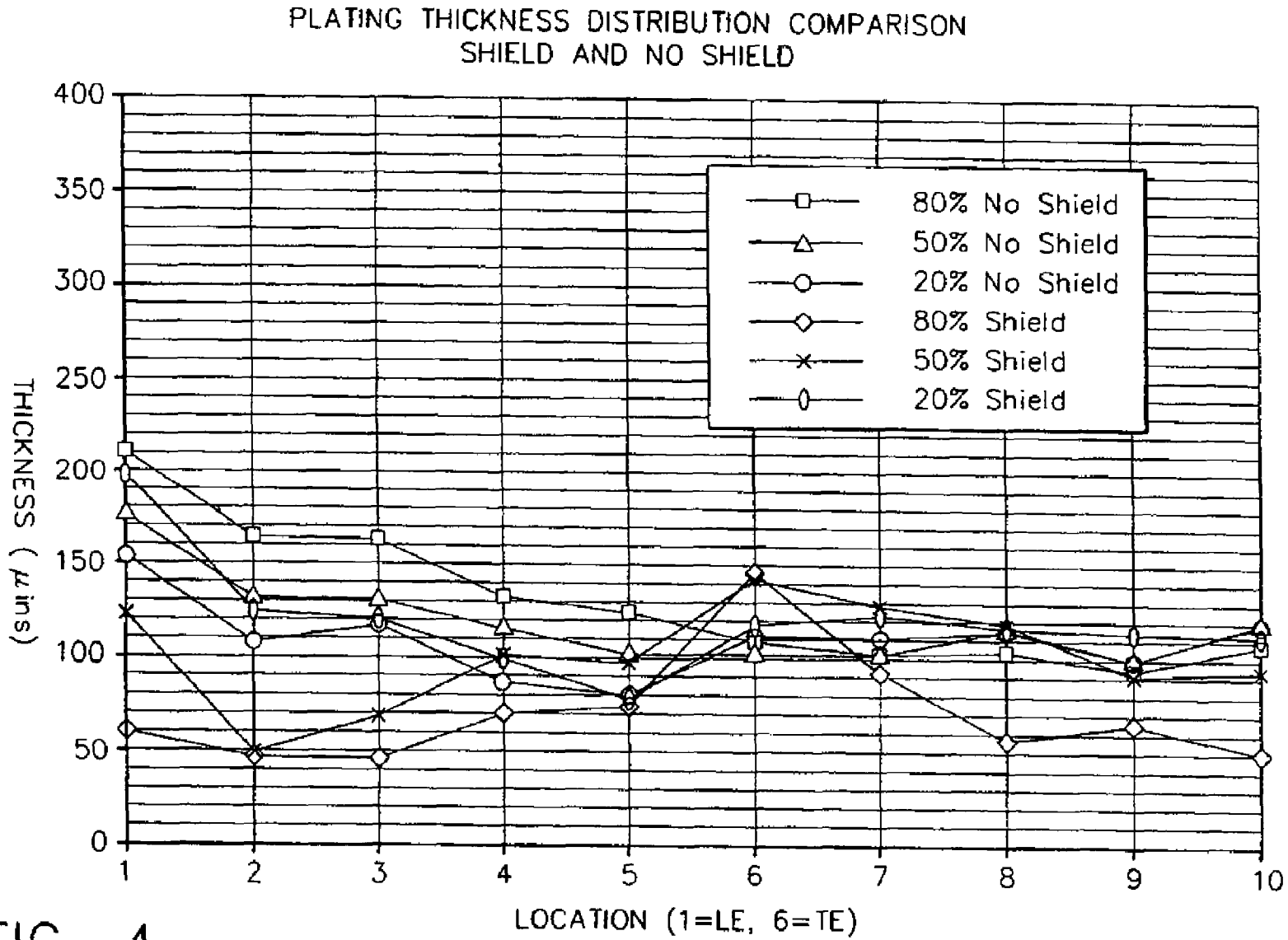
FIG. 4 is a table showing a comparison of conventional plating thickness distribution and plating thickness distribution according to the method of the invention.

Utilization of the shield 10 in the electroplating process with a blade-to-shield clearance of 0.15 inches (3.81 mm) demonstrates that the plating thickness at the 80% span and tip cap regions was reduced. The plating thicknesses at the 80% span position without the shield 10 are shown in FIG. 4 and are the maximum values observed on the airfoil 20. The location points 1-10 in FIG. 4 are located on the airfoil 20 in FIG. 5.

Likewise, utilization of the shield 10 both minimized the plating thickness and resulted in a more uniform thickness. When aluminided, sample airfoils 20 plated without use of the shield 10 exhibited a platinum aluminide coating thickness with a standard deviation averaging 0.40 mils, while samples plated with the high span shield 1—had a coating thickness standard deviation of 0.24 mils—a substantial improvement.

The method according to an embodiment of the invention includes the steps of first forming a shield 10 having a recess 11 conforming to the shape of at least a portion of the airfoil 20. The recess 11 has a clearance determined empirically to provide an optimum coating thickness deviation. The airfoil 20 is introduced into the recess 11 of the shield 10. An anode 14 and cathode 16 are attached to the airfoil 20 and the shield 10 and blade portions of the airfoil 20 are submerged, blade tip down, into the electroplating tank 30 containing a platinum electrolyte solution. The airfoil 20 is electroplated with platinum to a point where every portion of the airfoil 20 to be plated has been coated to at least a minimum thickness of platinum.

The airfoil 20 is then diffusion heat treated to create a metallurgical bond between the metal of the airfoil 20 and the platinum. The heat treated airfoil 20 is then reacted with an aluminum vapor in a VPA retort to create the required platinum aluminide coating.

A method and apparatus for electroplating an airfoil is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

That which is claimed is:

1. A method of electroplating a high temperature coating onto an airfoil, comprising:

providing a shield having a recess defining one or more walls conforming to the shape of at least a portion of a pressure side and a suction side of the airfoil to be electroplated, the recess defining a clearance gap of the airfoil of about 0.10to about 0.30 inches (2.54-7.62 mm);

introducing the portions of the pressure side and the suction side of the airfoil to be electroplated into the recess of the shield to form the defined clearance gap of about 0.10 to about 0.30 inches (2.54-7.62mm) between the shield and the portions of the pressure side and the suction side of the airfoil to be electroplated;

attaching and anode and cathode to the airfoil;

submerging at least the shield and the portions of the pressure side and the suction side of the airfoil to be electroplated into an electroplating tank containing an electrolyte; and electroplating a coating of a high temperature resistant metal onto the portions of the pressure side and the suction side of the airfoil to be electroplated to a predetermined minimum thickness.

2. A method according to claim 1, further comprising:

diffusion heat treating the airfoil to create a metallurgical bond between the airfoil and the electroplated coating; and reacting the heat treated airfoil with an aluminum vapor in a VPA retort to create an aluminide coating.

3. A method according to claim 1, wherein the high temperature resistant metal comprises platinum and wherein the airfoil comprises nickel.

4. A method according to claim 1, wherein providing a shield further comprises forming a recess in a polytetrafluoroethylene (PTFE) block.

5. A method according to claim 1, wherein electroplating a coating of a high temperature resistant metal onto the airfoil to a predetermined minimum thickness comprises applying a coating to the airfoil having a thickness of between about 50 and about 250 micro inches (1.27-6.35 microns) with a standard deviation of the coating thickness of about 0.24 mils (2.54 microns).

6. A method according to claim 1, wherein the clearance gap between the airfoil and the recess is between about 0.10 and about 0.20 inches (2.54-5.08 mm).

7. A method according to claim 6, wherein the clearance gap between the airfoil and the recess is about 0.15 inches (3.81 mm).

8. A method according to claim 1, wherein the airfoil has a high span region and the recess is formed to receive the high span region of the airfoil.

9. A method according to claim 1, wherein the electrolyte comprises a platinum group metal.

10. A method according to claim 1, wherein the high temperature coating is a platinum aluminide coating.

* * * * *